US006014821A

United States Patent [19]

Yaw

[11] Patent Number: 6,014,821

[45] Date of Patent: Jan. 18, 2000

[54] SEASHORE SANDAL

[75] Inventor: Larry Yaw, Taichung, Taiwan

[73] Assignee: Union Looper Co., Ltd., Taichung, Taiwan

[21] Appl. No.: 09/212,401

[22] Filed: Dec. 16, 1998

[51] Int. Cl.[7] ..... A43B 5/08; A43B 3/12; A43B 7/08

[52] U.S. Cl. ..... 36/8.1; 36/11.5; 36/3 B

[58] Field of Search ..... 36/8.1, 11.5, 3 B

[56] References Cited

U.S. PATENT DOCUMENTS 3,059,350 10/1962 Price .
3,461,575 8/1969 Tead et al. .
3,605,292 9/1971 Goldblatt .
4,525,940 7/1985 Mochizuki .
4,939,851 7/1990 Miller .
4,955,147 9/1990 Bos .
5,044,096 9/1991 Polegato .

*Primary Examiner*—Ted Kavanaugh
*Attorney, Agent, or Firm*—Bacon & Thomas, PLLC

[57] ABSTRACT

A seashore sandal includes a body which has drain holes and grooves in a recessed top chamber thereof and two recessed bottom chambers, an insole made of plastic wires and fastened to the recessed top chamber at the top side of the body, and two bottom blocks made of plastic wires and respectively fastened to the recessed bottom chambers at the bottom side of the body. Sands are carried away from the top side of the body through the grooves and the drain holes to the bottom side of the body when water is applied to the top side of the body.

4 Claims, 5 Drawing Sheets

SEASHORE SANDAL

BACKGROUND OF THE INVENTION

The present invention relates to seashore sandals, and more particularly to such a seashore sandal which enables sands to be quickly carried with water from the top side of the body of the sandal to the bottom side thereof.

Regular seashore sandals are commonly comprised of an integrated sandal body, and a plurality of straps mounted on the sandal body and adapted to secure the sandal body to the user's foot. When walking in the seashore, sands may be gathered in the top side of the sandal body. It is not easy to wash sands completely away from the sandal body with water.

SUMMARY OF THE INVENTION

It is one object of the present invention to provide a seashore sandal which enables accumulated sands to be quickly completely washed away with water. It is another object of the present invention to provide a seashore sandal which has means to massage the muscles of the foot when walking. To achieve these and other objects of the present invention, there is provided a seashore sandal comprised of a body which has drain holes and grooves in a recessed top chamber thereof and two recessed bottom chambers, an insole made of plastic wires and fastened to the recessed top chamber at the top side of the body, and two bottom blocks made of plastic wires and respectively fastened to the recessed bottom chambers at the bottom side of the body. Sands are carried away from the top side of the body through the grooves and the drain holes to the bottom side of the body when water is applied to the top side of the body. The wired structure of the insole massages the muscles of the foot when the user walks.

DETAILED DESCRIPTION OF THE PREFERRED EMBODIMENT

Figure 1:
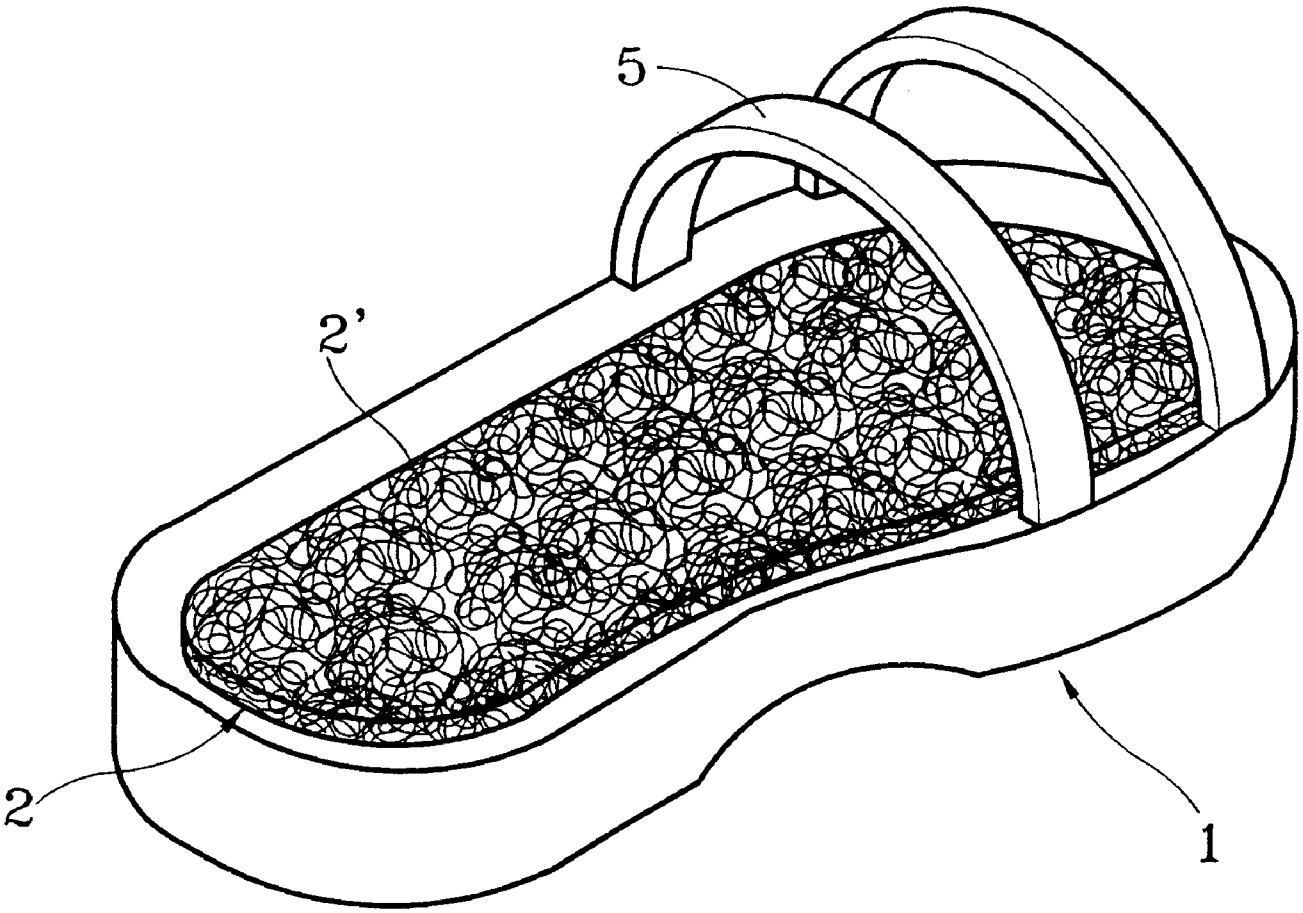
FIG. 1 is an elevational view of a seashore sandal according to the present invention.
Figure 2:
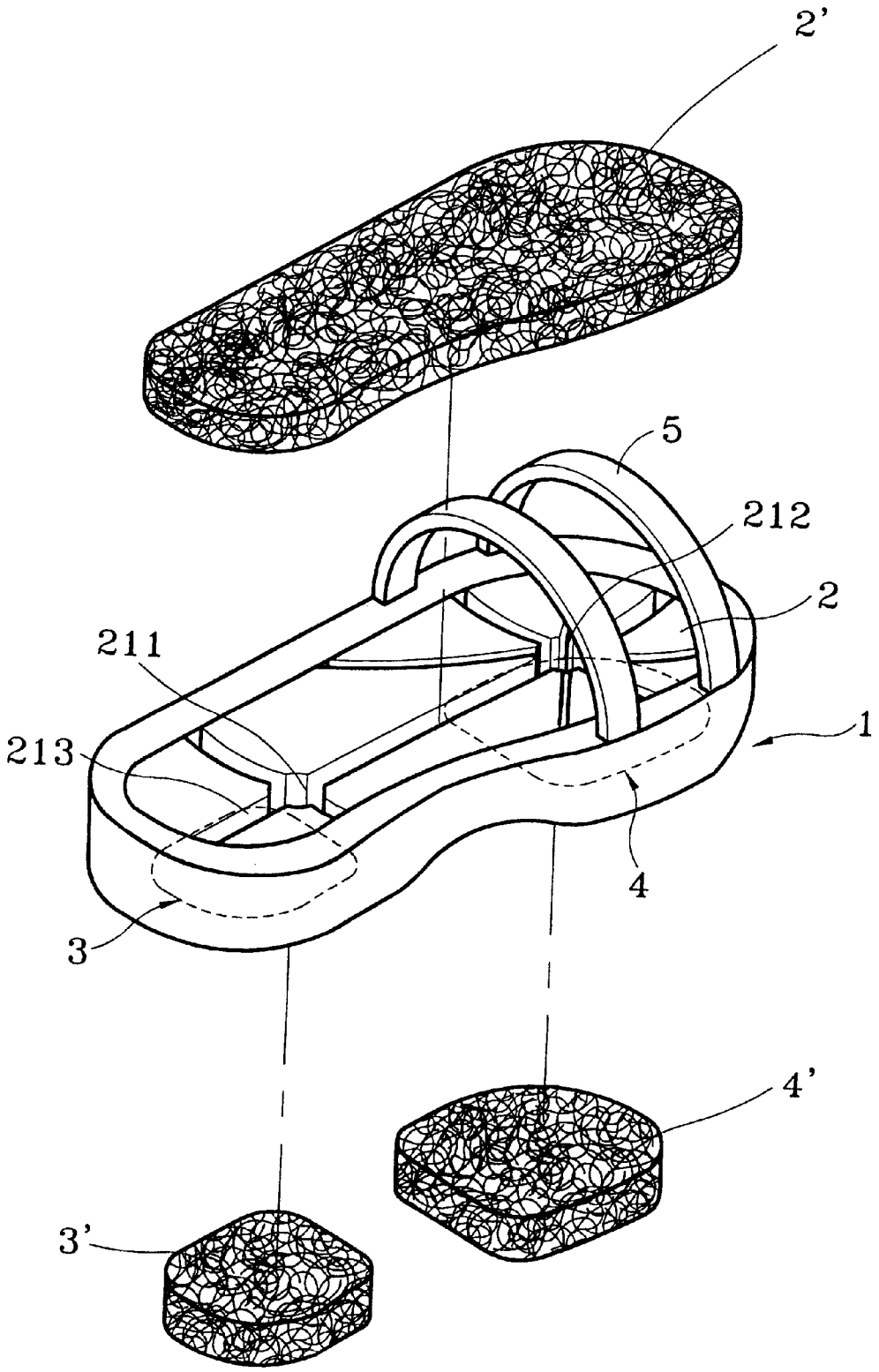
FIG. 2 is an exploded view of the seashore sandal shown in FIG. 1.
Figure 3A:
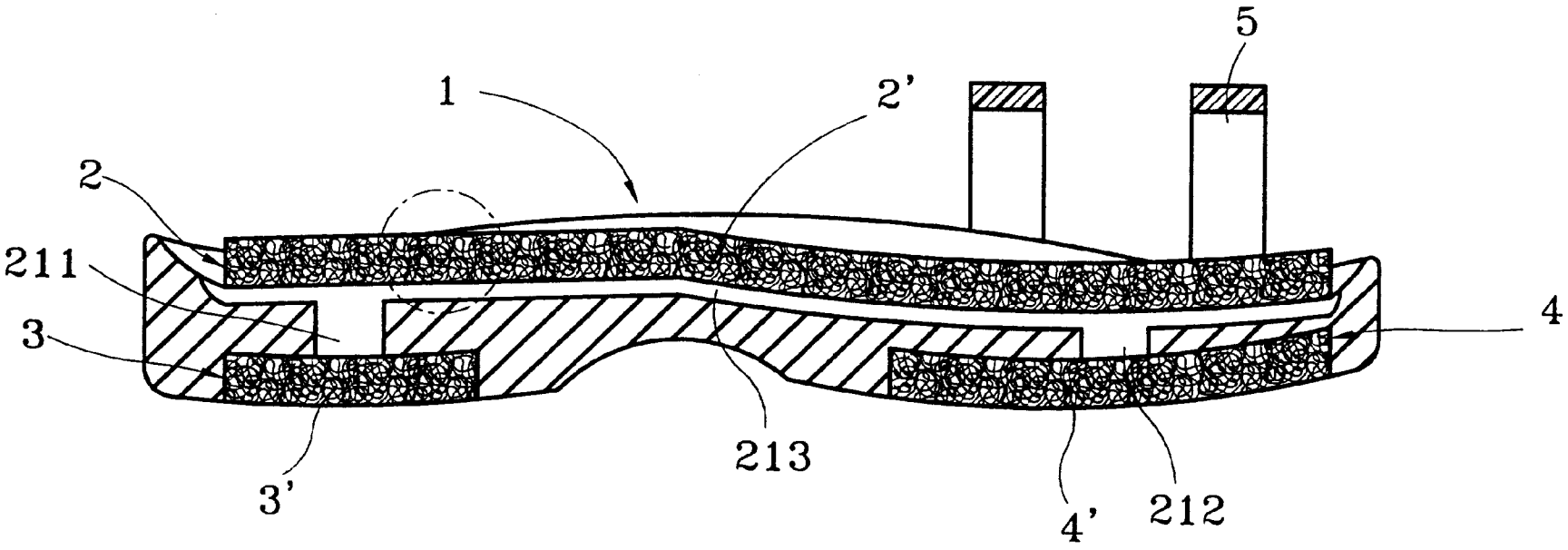
FIG. 3A is a side view in section of the seashore sandal shown in FIG. 1.
Figure 3B:
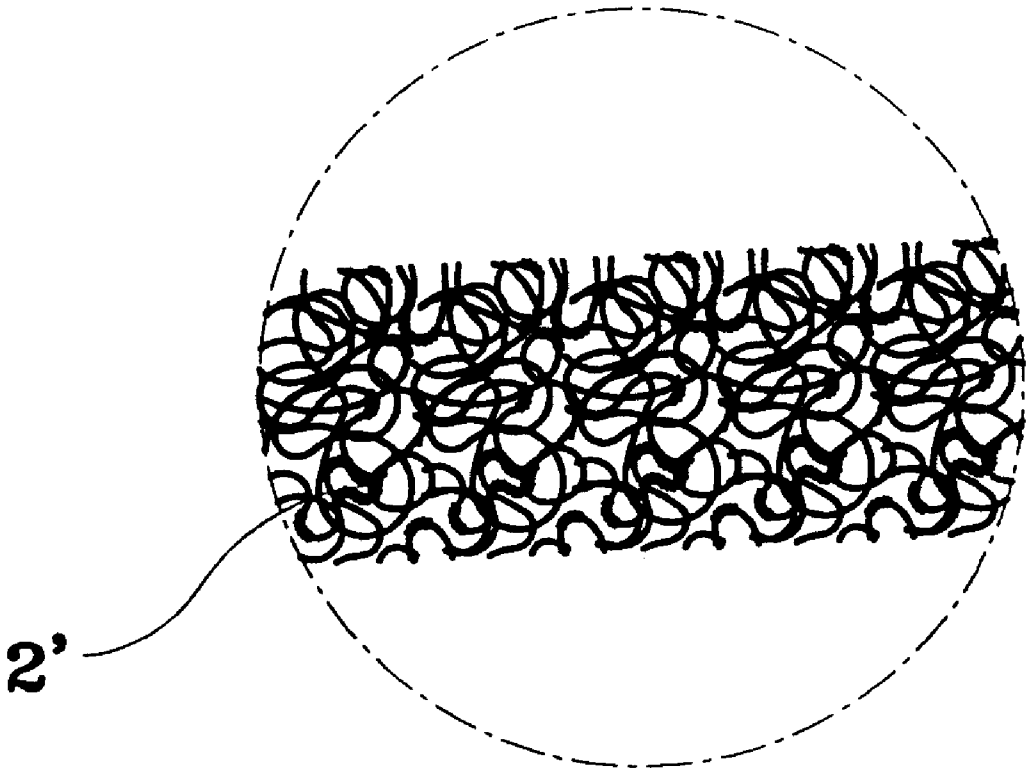
FIG. 3B is an enlarged view of a part of the insole according to the present invention.

Referring to FIGS. 1, 2, 3A and 3B, a seashore sandal in accordance with the present invention is generally comprised of a body 1, and straps 5 for securing the body 1 to the user's foot. The body 1 comprises a recessed top chamber 2 defined within the top side wall thereof, a first recessed bottom chamber 3 and a second recessed bottom chamber 4 defined within the bottom side wall thereof, a first drain hole 211 in communication between the recessed top chamber 2 and the first recessed bottom chamber 3, a second drain hole 212 in communication between the recessed top chamber 2 and the second recessed bottom chamber 4, and a plurality of grooves 213 at the top side wall in communication with the drain holes 211 and 212. The recessed top chamber 2 has a bottom side smoothly downwardly curved from the rear side of the body 1 toward the front side thereof. An insole 2' and two bottom blocks 3' and 4' are respectively fastened to the recessed top chamber 2 and the recessed bottom chambers 3 and 4 in flush with the top side wall and bottom side wall of the body 1. The insole 2' and two bottom blocks 3' and 4' are respectively made of plastic wires, having open spaces through which sands can be carried by water. When the user walks, the muscles of the foot are massaged by the wired structure of the insole 2'.

Figure 4:
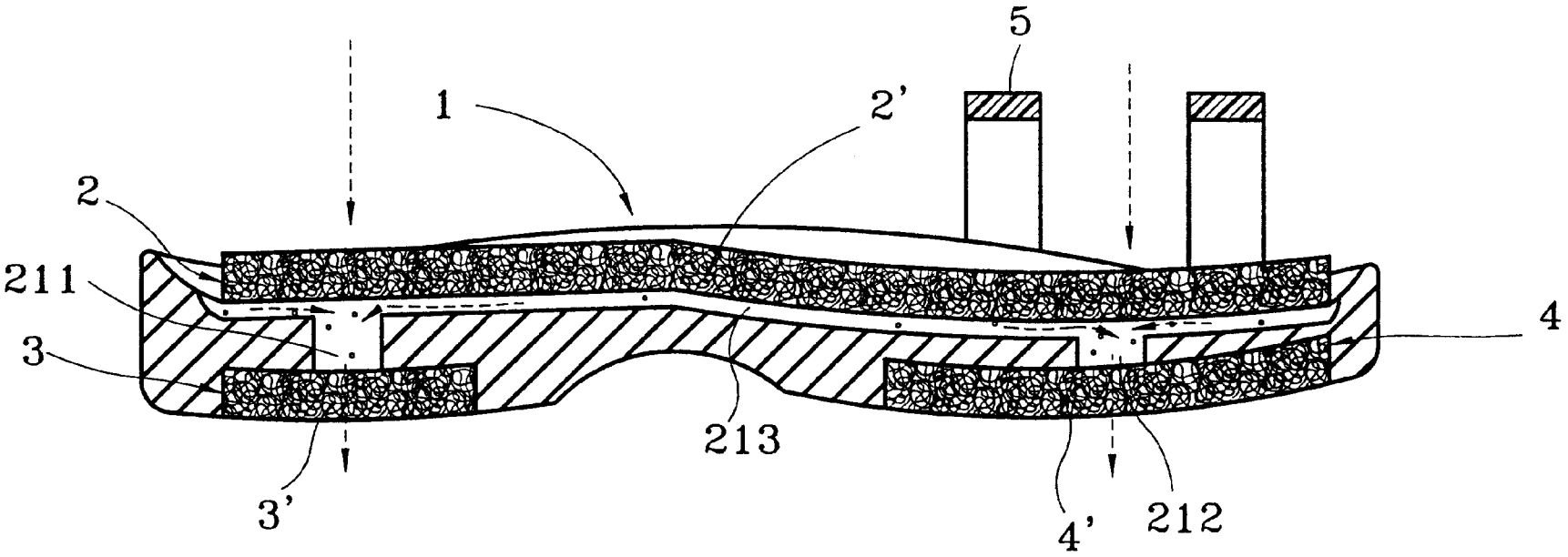
FIG. 4 is an applied view of the present invention, showing water applied to the top side of the body, sands carried with water from the top side of the body to the bottom side of the body through the drain holes.

Referring to FIG. 4, when applying water to the top side of the seashore sandal, sands which are gathered in the insole 2' are immediately carried away from the insole 2' by running water through the grooves 213 and the drain holes 211 and 212 to the bottom side of the body 1.

In order to let water be quickly guided away from the insole 2' to the drain holes 211 and 212, the grooves 213 are preferably radially extended from the drain holes 211 and 212 at the middle area of the recessed top chamber 2 to the border area of the recessed top chamber 2.

While only one embodiment of the present invention has been shown and described, it will be understood that various modifications and changes could be made thereunto without departing from the spirit and scope of the invention disclosed. For example, rubber cushion blocks that have open spaces may be used and installed in the recessed bottom chambers 3 and 4 instead of the aforesaid bottom blocks 3' and 4'.

What is claimed is:

1. A seashore sandal comprising:

a sandal body, said sandal body comprising a recessed top chamber defined within a top side wall thereof, a first recessed bottom chamber and a second recessed bottom chamber defined within a bottom side wall thereof, a first drain hole in communication between said recessed top chamber and said first recessed bottom chamber, a second drain hole in communication between said recessed top chamber and said second recessed bottom chamber, and a plurality of grooves at the top side wall in communication with said drain holes;

a plurality of straps respectively mounted on said sandal body and adapted to secure said sandal body to the user's foot; and an insole made of plastic wires and fastened to said recessed top chamber in flush with the top side wall of said sandal body, said insole having open spaces through which sands can be carried away from the top side wall of said sandal body to the bottom side of said sandal body through said grooves and said drain waters by water.

2. The seashore sandal of claim 1 wherein said recessed top chamber has a bottom wall smoothly downwardly curved from a rear side of said sandal body toward a front side of said sandal body.

3. The seashore sandal of claim 1 further comprising two bottom blocks respectively made of plastic wires and fastened to said first and second recessed bottom chambers in flush with the bottom side wall of said sandal body, said bottom blocks having open spaces through which sands can be carried by water.

4. The seashore sandal of claim 1 wherein said grooves are radially extended from said drain holes to the border area of said recessed top chamber.

* * * * *